US010912371B2

(12) United States Patent
Yeung et al.

(10) Patent No.: US 10,912,371 B2
(45) Date of Patent: Feb. 9, 2021

(54) DUAL END COSMETIC CONTAINER

(71) Applicant: CRYSTAL INTERNATIONAL (GROUP), INC., East York (CA)

(72) Inventors: Ting-Hin Yeung, Markham (CA); Roger Ting Chih Hwang, Maple (CA); Yuen Han Chow, Scarborough (CA); Wen Wendy Tung, Scarborough (CA)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 78 days.

(21) Appl. No.: 16/217,028

(22) Filed: Dec. 11, 2018

(65) Prior Publication Data

US 2019/0110580 A1 Apr. 18, 2019

Related U.S. Application Data

(63) Continuation-in-part of application No. 15/201,980, filed on Jul. 5, 2016, now Pat. No. 10,154,720.

(51) Int. Cl.

| | |
|---|---|
| ***B43K 27/02*** | (2006.01) |
| ***A45D 40/24*** | (2006.01) |
| ***A45D 40/06*** | (2006.01) |
| ***A45D 40/20*** | (2006.01) |
| ***A45D 40/26*** | (2006.01) |

(52) U.S. Cl.

CPC ..... *A45D 40/24* (2013.01); *A45D 40/06* (2013.01); *A45D 40/205* (2013.01); *A45D 40/262* (2013.01); *A45D 2040/208* (2013.01)

(58) Field of Classification Search

CPC ..... A45D 40/18; A45D 40/24; A45D 40/04; A45D 40/06; A45D 40/065; A45D 40/205; A45D 2040/208

USPC ..... 401/19

See application file for complete search history.

(56) References Cited

U.S. PATENT DOCUMENTS

| | | | |
|---|---|---|---|
| 6,773,184 | B2 | 8/2004 | An |
| 8,444,334 | B2 | 5/2013 | Cardia |
| 8,662,775 | B1 | 3/2014 | Liu |

(Continued)

FOREIGN PATENT DOCUMENTS

| | | | |
|---|---|---|---|
| DE | 3923731 | A1 | 1/1991 |
| EP | 2074903 | A1 | 7/2009 |

(Continued)

OTHER PUBLICATIONS

French International Search Report and Written Opinion for French Application No. FR1755997; dated Dec. 19, 2019; 7 total pages.

*Primary Examiner* — Jennifer C Chiang

(74) *Attorney, Agent, or Firm* — Patterson + Sheridan, LLP

(57) ABSTRACT

A dual end container for products such as cosmetics provided. Specifically, a dual end container with a compact, integrated mechanism for selectively extending and retracting a first product or applicator without movement of a second product or applicator is disclosed. The dual end container includes a first cup, a second cup, which is at least partially housed within the first cup, and a driving member assembly, which includes a first driving member and a second driving member, between the first cup and the second cup. The first cup has a first male thread, the second cup has a second male thread, the first driving member has a first female thread, and the second driving member has a second female thread. The male threads interact with the corresponding female threads to extend and retract the corresponding cups.

16 Claims, 8 Drawing Sheets

(56) References Cited

U.S. PATENT DOCUMENTS

| | | | |
|---|---|---|---|
| 8,662,776 | B2 | 3/2014 | Porter et al. |
| 8,967,896 | B2 | 3/2015 | Johnson et al. |
| 9,095,199 | B2 | 8/2015 | Chen |
| 9,549,604 | B2 | 1/2017 | Liu |
| 2015/0055997 | A1 | 2/2015 | Holloway |
| 2015/0250290 | A1 | 9/2015 | Holloway |

FOREIGN PATENT DOCUMENTS

| | | | |
|---|---|---|---|
| FR | 2869206 | A1 | 10/2005 |
| KR | 20120046859 | A | 5/2012 |
| WO | 2011/131794 | A1 | 10/2011 |

DUAL END COSMETIC CONTAINER

CROSS-REFERENCE TO RELATED APPLICATIONS

This application is a continuation-in-part of co-pending U.S. patent application Ser. No. 15/201,980, filed on Jul. 5, 2016, which is herein incorporated by reference in its entirety.

BACKGROUND

Field

The present disclosure generally relates to a dual end container for applying personal products, such as cosmetic products. More specifically, a dual end container with a compact, integrated mechanism for selectively extending and retracting a first product without movement of a second product is disclosed.

Description of the Related Art

The cosmetics industry is a large industry and provides consumers with a myriad of products. Many consumers use multiple cosmetic products throughout the day. Accordingly, these consumers carry their preferred products in their personal items, such as a handbag. Typically, each individual product is housed in its own container, though there are some containers which house two or more cosmetic products.

However, traditional dual cosmetic containers are bulky because they require two distinct mechanisms, each of which takes up a lot of space in the container.

Therefore, there is a need for an improved dual end container.

SUMMARY

In one example, a dual end container includes a first cup, a second cup, the first and second cups facing in opposite directions and aligned along a longitudinal axis of the dual end container, and a driving member assembly positioned between the first cup and the second cup and adapted to selectively move the first cup and the second cup, wherein the driving member assembly comprises a first driving member having a first threaded member coupled to the first cup, the first threaded member having an interior volume, and a second driving member having a second threaded member coupled to the second cup and at least partially disposed within the interior volume of the first threaded member.

In another example, a dual end container includes a driving member assembly comprising a first driving member having an interior volume formed therein with a first female thread and a second driving member having an interior volume formed therein with a second female thread formed in the interior volume, the second driving member being joined with the first driving member to form the driving member assembly, a first cup coupled to a first side of the first driving member, the first cup having an interior volume and an outer surface with a first male thread formed thereon, and a second cup coupled to a the second side of the driving member, the second cup having an outer surface with a second male thread formed thereon, wherein a diameter of the outer surface of the second cup is less than a diameter of the interior volume of the first cup and the second cup is at least partially housed within the interior volume of the first cup.

In yet another example, a method for filling a dual end container includes filling a first cup of a first dual end container portion with a first product, filling a second cup of a second dual end container portion with a second product, and coupling the first dual end container portion to the second dual end container portion.

In summation, the present disclosure generally relates to a dual end container for products such as cosmetic products. More specifically, a dual end container with a compact, integrated mechanism for selectively extending and retracting a first product or product applicator without movement of a second product or product applicator is disclosed. The dual end container includes a first cup, a second cup, which is at least partially housed within the first cup, and a driving member assembly between the first cup and the second cup. The first cup has a first male thread, the second cup has a second male thread and the first driving member has a first female thread and the second driving member has a second female thread. The first male thread interacts with the first female thread to extend and retract the first cup. The second male thread interacts with the second female thread to extend and retract the second cup.

BRIEF DESCRIPTION OF THE DRAWINGS

So that the manner in which the above recited features of the present disclosure can be understood in detail, a more particular description of the disclosure, briefly summarized above, may be had by reference to examples, some of which are illustrated in the appended drawings. It is to be noted, however, that the appended drawings illustrate only typical examples of this disclosure and are therefore not to be considered limiting of its scope, for the disclosure may admit to other equally effective examples.

To facilitate understanding, identical reference numerals have been used, where possible, to designate identical elements that are common to the figures. It is contemplated that elements and features of one example may be beneficially incorporated in other example without further recitation.

DETAILED DESCRIPTION

The present disclosure generally relates to a dual end container for applying personal products, such as cosmetic products. The dual end container has a compact, integrated mechanism for selectively extending and retracting a first product or a first applicator from one end of the container without movement of a second product or a second applicator disposed at an opposite end of the container and vice versa. The dual end container includes a first cup, a second cup and a driving member assembly, which includes a first driving member and a second driving member, disposed between the first cup and the second cup. The first cup has a first male thread, the second cup has a second male thread, the first driving member has a first female thread, and the second driving member has a second female thread. The first male thread interacts with the first female thread to extend and retract the first cup without movement of the second cup. The second male thread interacts with the second female thread to extend and retract the second cup without movement of the first cup. This selective extension enables the consumer to select the product or the applicator to be used and only advance that product or applicator without unnecessarily extending the other product or applicator.

Figure 1A:
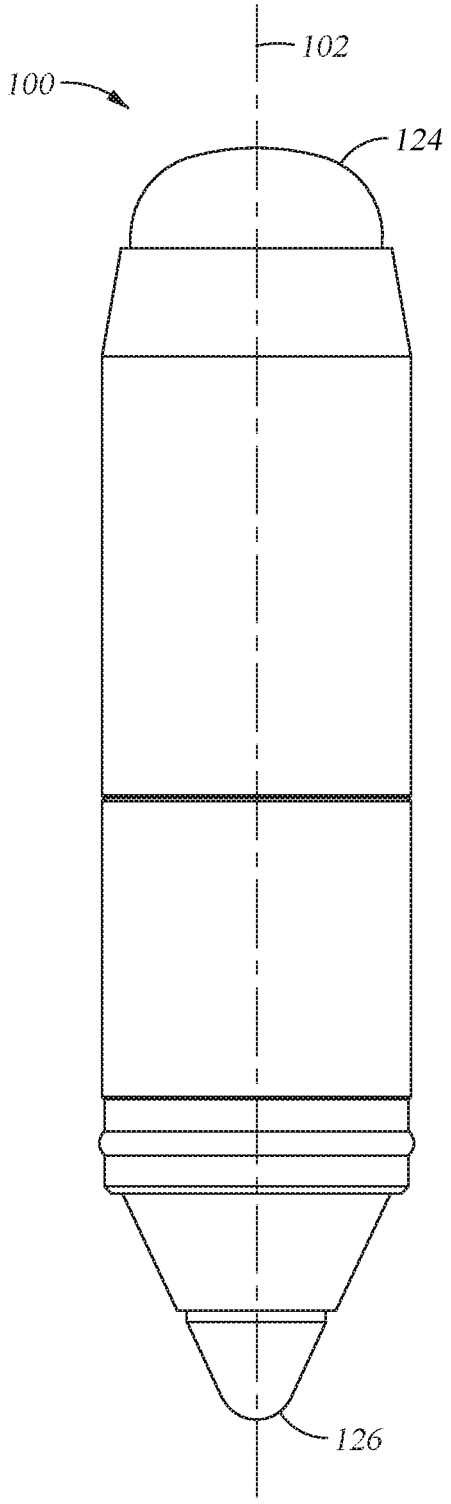
FIG. 1A is a front view of a dual end container according to one example.

FIG. 1A is a front view of a dual end container 100 according to one example. The dual end container 100 is configured to house a first product 124 and a second product 126. The dual end container 100 has a longitudinal axis 102.

Figure 1B:
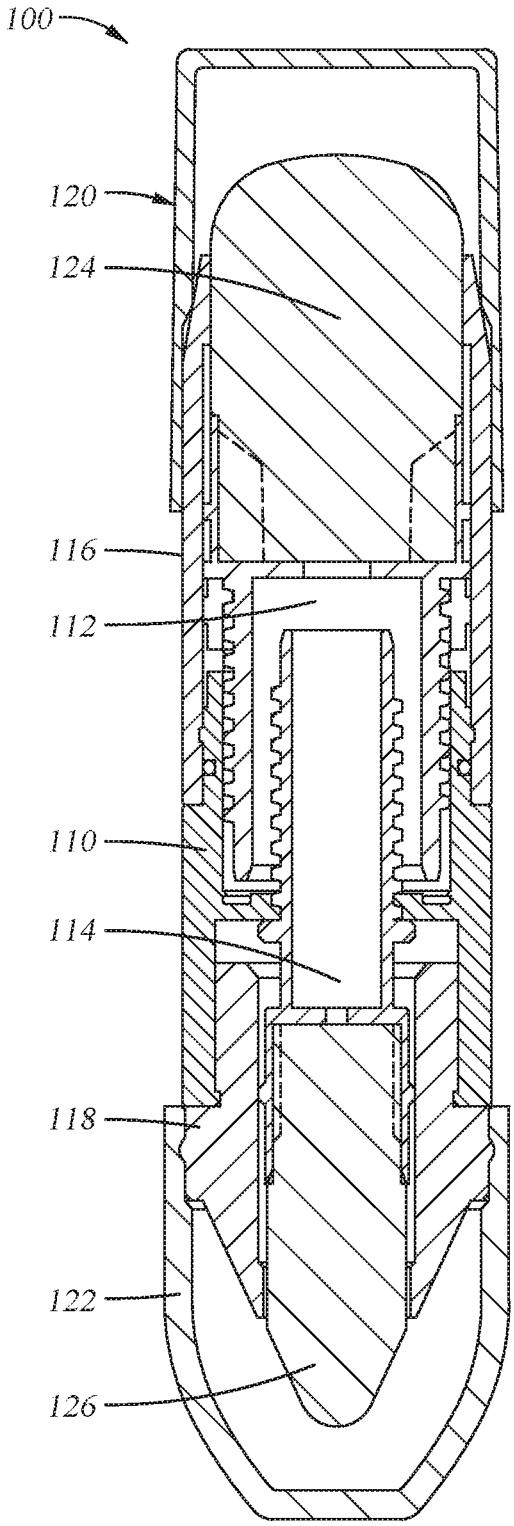
FIG. 1B is a schematic cross-sectional view of the dual end container of FIG. 1A.

FIG. 1B is a schematic cross-sectional view of the dual end container 100 of FIG. 1A. The dual end container 100 includes a driving member 110, which is located between a first cup 112 and a second cup 114 along the longitudinal axis 102. A first shell 116 surrounds the first cup 112 and a second shell 118 surrounds the second cup 114. A first cap 120 couples with the first shell 116 and a second cap 122 couples with the second shell 118. The first cup 112 is configured to contain the first product 124 and the second cup 114 is configured to contain the second product 126. For example, the first cup 112 may include a product container portion 130 for holding the first product 124. Likewise, the second cup 114 may include a product container portion 132 for holding the second product 126.

The dual end container 100 includes a threaded region 123 that moves one or both of the first cup 112 and the second cup 114 along the longitudinal axis 102 when relative movement is provided between the driving member 110 and the first cup 112 or the second cup 114. The first cup 112 is adapted to move along the longitudinal axis 102 in an enlarged internal region 125 of the first shell 116. Likewise, the second cup 114 is adapted to move along the longitudinal axis 102 in an enlarged internal region 127 of the second shell 118. The first shell 116 may include a stop mechanism such as a first stop 128 that interacts with a shoulder 134 that extends radially outward from the product container portion 130. When the first cup 112 is moved along the longitudinal axis 102 away from the driving member 110, the shoulder 134 contacts the first stop 128 to prevent additional movement of the first cup 112 along the longitudinal axis 102. Likewise, the second shell 118 may include a stop mechanism such as a second stop 129 that interacts with a shoulder 136 that extends radially outward from the product container portion 132. When the second cup 114 is moved along the longitudinal axis 102 away from the driving member 110, the shoulder 136 contacts the second stop 129 to prevent additional movement of the second cup 114 along the longitudinal axis 102.

Figure 2A:
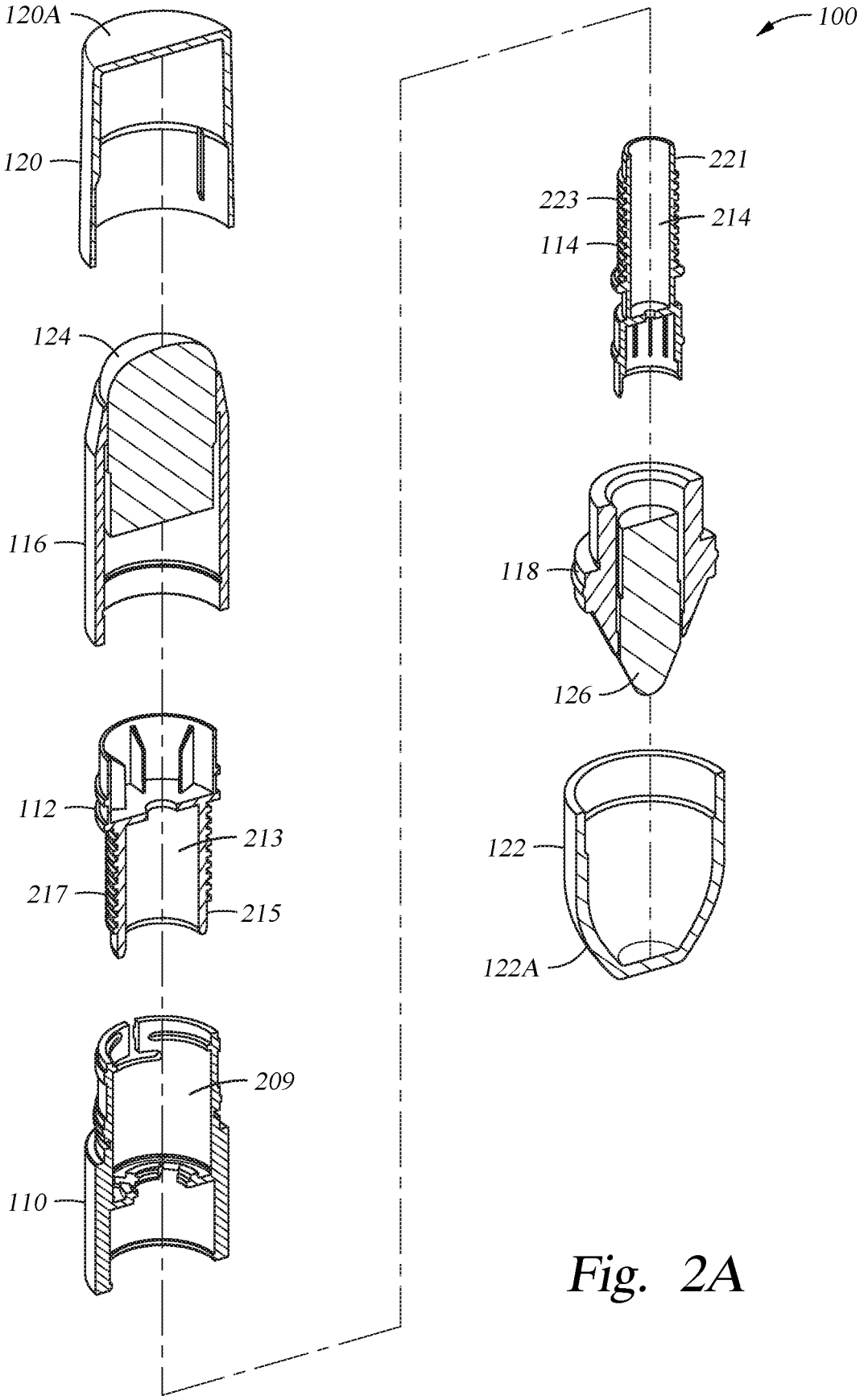
FIG. 2A is an exploded cross-sectional view of the dual end container of FIG. 1B.
Figure 2B:
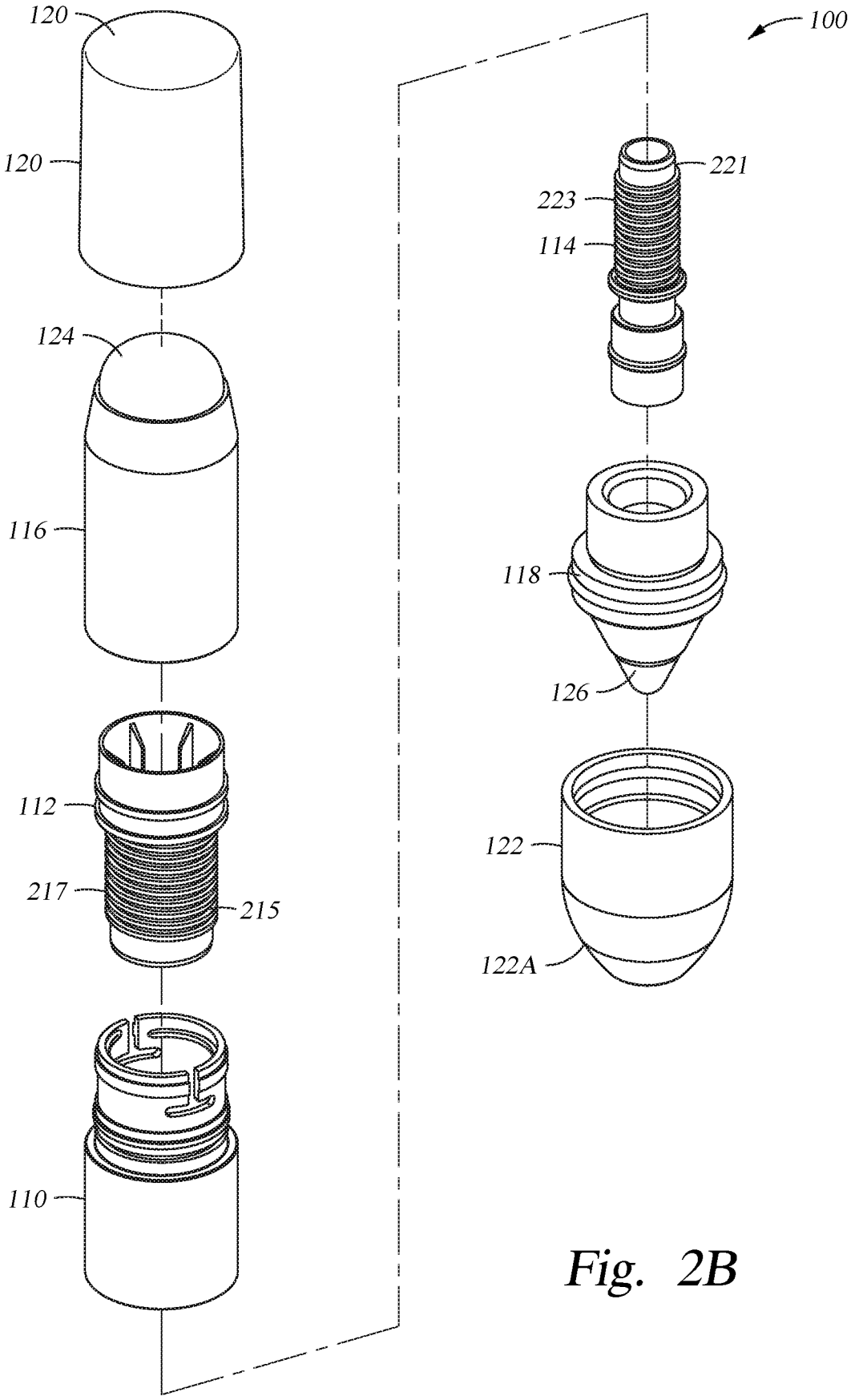
FIG. 2B is an exploded isometric view of the dual end container of FIG. 1B.
Figure 2C:
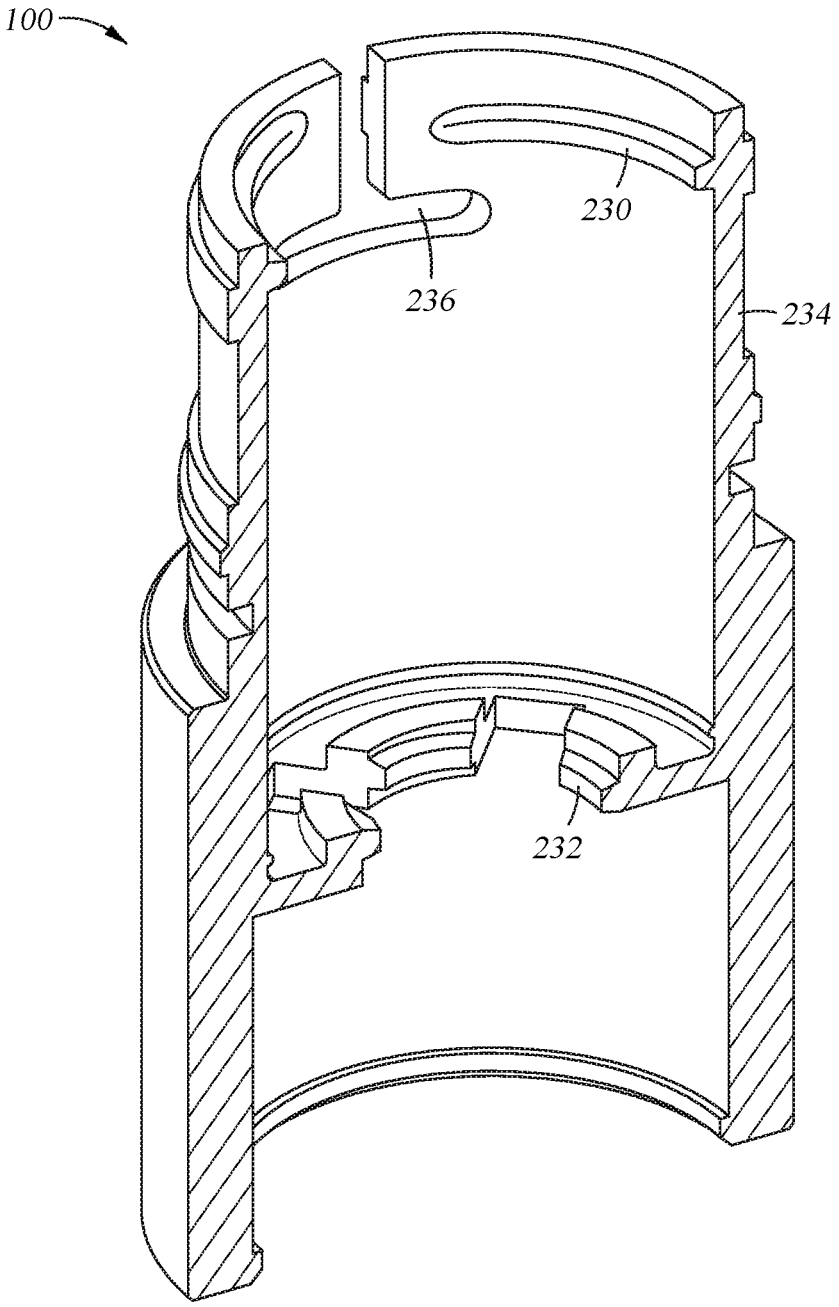
FIG. 2C is an enlarged cross-sectional view of the driving member shown in FIG. 2A.

FIG. 2A is an exploded cross-sectional view of the dual end container 100 of FIG. 1B. FIG. 2B is an exploded isometric view of the dual end container 100 of FIG. 1B. FIG. 2C is an enlarged cross-sectional view of the driving member 110. As shown in FIGS. 2A-2C, the driving member 110 is a hollow body enclosing an interior volume 234 and has a groove/cut out 236 towards proximal end. Further, the driving member 110 has a first threaded member 230 near proximal portion or first side and a second threaded member 232 near distal portion or second side. A portion of first cup 112 is received in the interior volume 234 in the proximal portion of the driving member and a portion of the second cup 114 is received in the interior volume 234 in the distal portion of the driving member 110. As shown in FIGS. 2A-2B, the first cup 112 has an interior volume 213 and an outer surface 215 with a first male thread 217 formed thereon. The second cup 114 has an interior volume 219 and an outer surface 221 with a second male thread 223 formed thereon. A diameter of the outer surface 221 is less than a diameter of the interior volume 213 such that the second cup 114 is at least partially housed within the interior volume 213 of the first cup 112. The first threaded member 230 engages with first male thread 217 and the second threaded member 232 engages with second male thread 223.

The first male thread 217 and the second male thread 223 may be right-handed threads, the first male thread 217 and the second male thread 223 may be left-handed threads, the first male thread 217 may be a right-handed thread and the second male thread 223 may be a left-handed thread, or the first male thread 217 may be a left-handed thread and the second male thread 223 may be a right-handed thread.

Each of the driving member 110, the first cup 112, the second cup 114, the first shell 116, the second shell 118, the first cap 120, and the second cap 122 may be made of plastic, or any other suitable material. In one example, the first product 124 and the second product 126 may be a cosmetic product, such as lipstick, lip gloss, foundation, mascara, eye liner, eye shadow, or cheek color. Additionally, one or both of the first product 124 and the second product 126 may be replaced with cosmetic applicators, such as a sponge or a brush. In another example, the first product 124 and the second product 126 may be personal care products, such as deodorant. In yet another example, one or both of the first product 124 and the second product 126 may be skincare products. In even further examples, the first product 124 and the second product 126 may be hair products or pet products. In still further examples, the first product 124 and the second product 126 may be dental products.

The first cap 120 and the second cap 122 are removable from the first shell 116 and the second shell 118, respectively. As shown in FIGS. 2A and 2B, the first cap 120 has a top surface 120A that is flat, whereas the second cap 122 has a top surface 122A that is tapered. According to other alternate examples, the first cap 120 and the second cap 122 may have other desired shapes. The first cap 120 may be sized to removeably snap fit to or interference fit with the first shell 116. The second cap 122 may be sized to loosely cover the second shell 118. Because the second cap 122 loosely covers the second shell 118, the second cup 114, and thus the second product 126, cannot be accidentally actuated while the second cap 122 is still on. In order for the second product 126 to be actuated and translated along the longitudinal axis 102 of the dual end container 100, the consumer must purposefully remove the second cap 122.

The driving member 110 is engaged with the first shell 116 and the second shell 118 such that the driving member 110 is rotatable relative to the first shell 116 and the second shell 118, respectively. In operation, when the first shell 116 is rotated relative to the driving member 110 and the first cup 112 is rotationally constrained relative to the first shell 116, the first cup 112 moves axially along the longitudinal axis 102 of the dual end container 100. Alternatively, when the driving member 110 is rotated relative to the first shell 116 and the first cup 112 is rotationally constrained relative to the first shell 116, the first cup 112 moves axially along the longitudinal axis 102 of the dual end container 100. More specifically, rotating the first shell 116 or the driving member 110 results in interfacing of the first male thread 217 with the first threaded member 230. Rotating the first shell 116 or the driving member 110 in a first direction, for example to the left side of the page as shown in FIGS. 1A-2C, extends the first cup 112 and the first product 124 longitudinally out of the dual end container 100, whereas rotating the first shell 116 or the driving member 110 in a second direction, for example to the right side of the page as shown in FIGS. 1A-20, retracts the first cup 112 and the first product 124 longitudinally into the dual end container 100.

Similarly, when the second shell 118 is rotated relative to the driving member 110 and the second cup 114 is rotationally constrained relative to the second shell 118, the second cup 114 moves axially along the longitudinal axis 102 of the dual end container 100. Alternatively, when the driving member 110 is rotated relative to the second shell 118 and the second cup 114 is rotationally constrained relative to the second shell 118, the second cup 114 moves axially along the longitudinal axis 102 of the dual end container 100. Rotating the second shell 118 or the driving member 110 results in interfacing of the second male thread 223 with the second threaded member 232. Rotating the second shell 118 or the driving member 110 in a first direction, for example clockwise (to the left side of the page as shown in FIGS. 1A-2C), extends the second cup 114 and the second product 126 longitudinally out of the dual end container 100, whereas rotating the second shell 118 or the driving member 110 in a second direction, for example counterclockwise (to the right side of the page as shown in FIGS. 1A-20), retracts the second cup 114 and the second product 126 longitudinally into the dual end container 100.

One or more of the first stop 128, the second stop 129 and the groove 236 may prevent disassembling of the parts of the dual end container 100. When the first cup 112 is extended by rotation of the first shell 116 relative to the driving member 110, the first cup 112 may be prevented from overextending from the dual end container 100 by the first stop 128 of the first shell 116. The first stop 128 is an inwardly extending protrusion of the first shell 116, which the first cup 112 cannot pass. Similarly, the second cup 114 may be prevented from overextending from the dual end container 100 by the second stop 129 of the second shell 118. The second stop 129 is an inwardly extending protrusion of the second shell 118, which the second cup 114 cannot pass. Additionally, the groove 236, shown in FIG. 2C, weakens the reacting force of the first threaded member 230. In other words, the groove 236 prevents the first cup 112 from forcing the first shell 116 and the driving member 110 apart.

Figure 3:
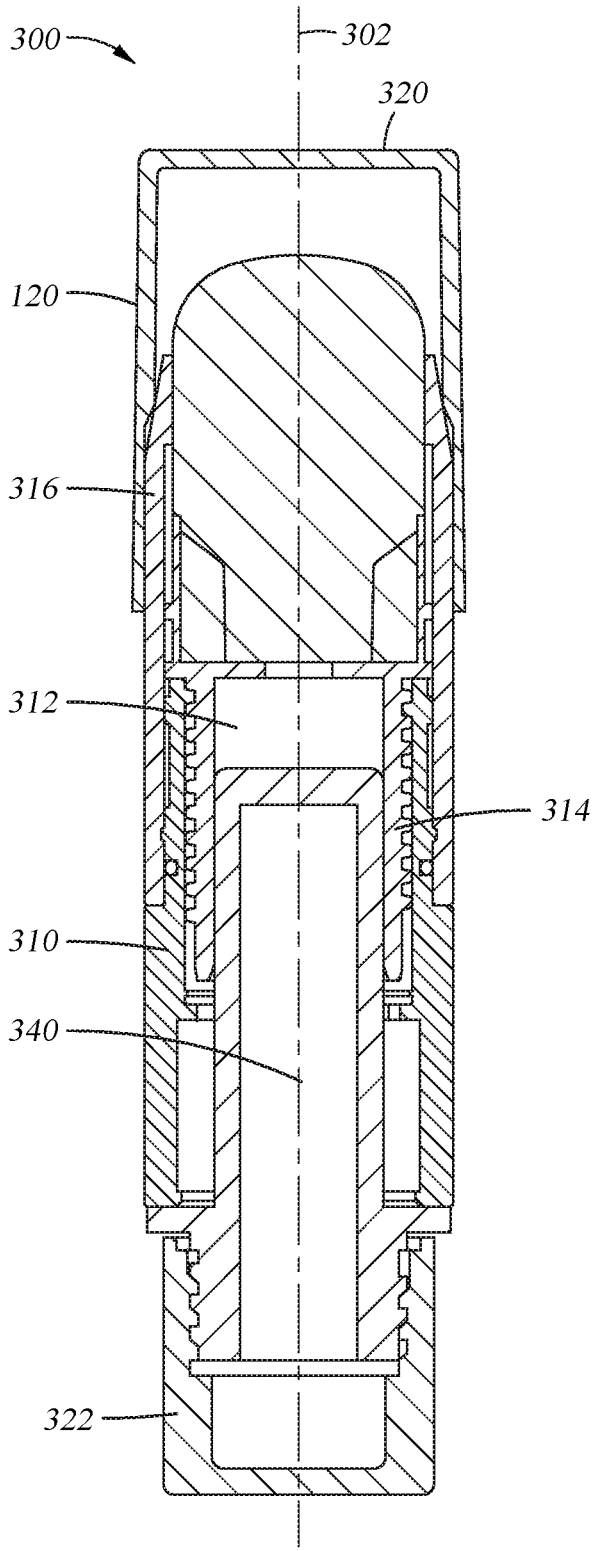
FIG. 3 is a schematic cross-sectional view of a dual end container according to another example.

FIG. 3 is a schematic cross-sectional view of a dual end container 300 according to another example. The dual end container 300 is similar to the dual end container 100 except that the second cup is replaced by a vial 340. As shown in FIG. 3, the first cup 312 holds the vial 340. The vial 340 may contain a second product. For example, the vial 340 may contain a lip gloss, a perfume, a skin care solution, a dental solution, a pet care solution, or other product. Alternatively, the second cup 314 may be configured to hold a cartridge for dispensing a product. The vial 340, or alternatively the cartridge, may be plastic, glass, or any other suitable material.

In operation, when the first shell 316 is rotated relative to the driving member 310 and the first cup 312 is rotationally constrained relative to the first shell 316, the first cup 312 moves axially along the longitudinal axis 302 of the dual end container 300. Alternatively, when the driving member 310 is rotated relative to the first shell 316 and the first cup 312 is rotationally constrained relative to the first shell 316, the first cup 312 moves axially along the longitudinal axis 302 of the dual end container 300. In this example, the vial 340 does not move axially along the longitudinal axis 302 of the dual end container 300. Instead, the vial 340 remains stationary in the dual end container 300 and the consumer may remove the second cap 322, which is disposed over the vial 340, to access the product contained within the vial 340.

Figure 4:
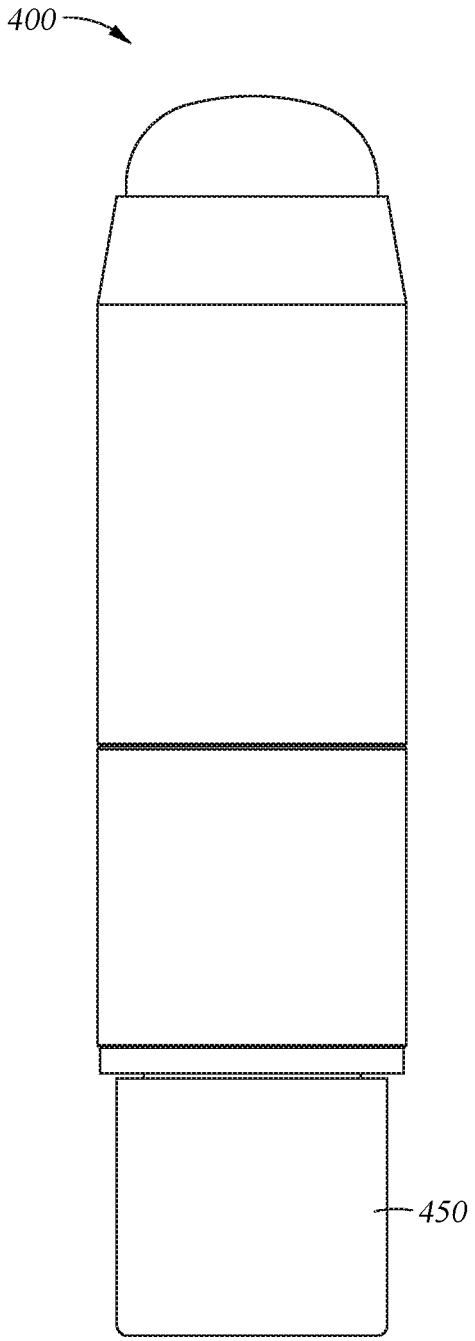
FIG. 4 is a front view of a dual end container according to yet another example.

FIG. 4 is a front view of a dual end container 400 according to yet another example. The dual end container 400 is similar to the dual end container 100 except that the second cup is configured to hold an applicator 450. Examples of applicator 450 include a sponge, a brush, a spatula, a flocked tip, a non-flocked tip among others.

While the above described examples contemplate disposing the first threaded member 230 and the second threaded member 232 on the driving member 110, in yet another example, the first threaded member 230 and the second threaded member 232 could be disposed in the first shell 116 and the second shell 118, respectively. Disposing the first threaded member 230 in the first shell 116 and the second threaded member 232 in the second shell 118 may result in a more integrated mechanism, which may further shorten the length of the dual end container 100.

Figure 5:
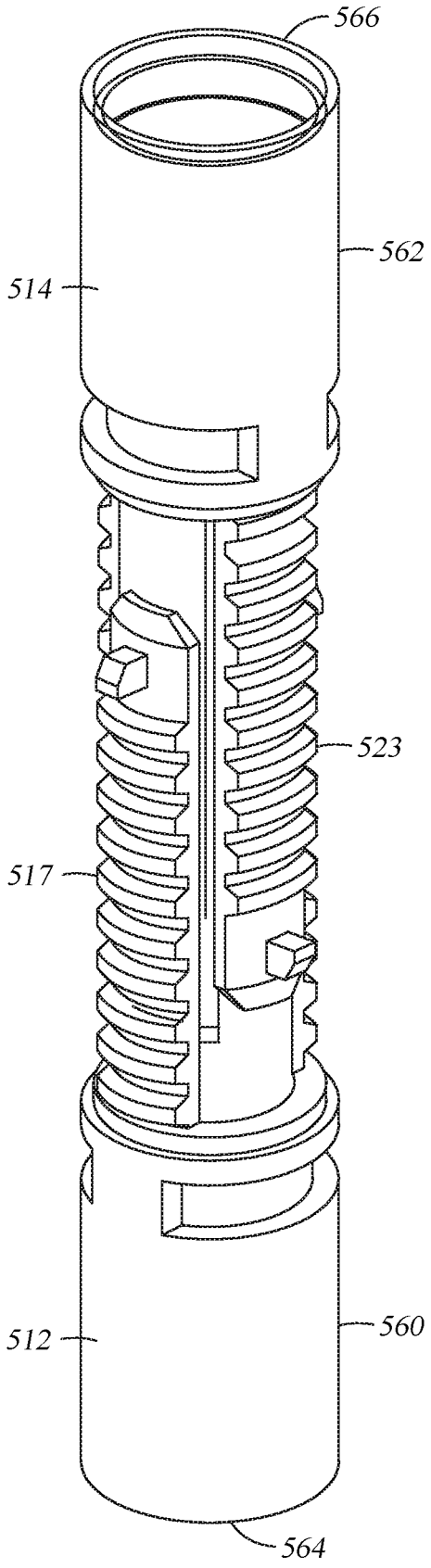
FIG. 5 is a perspective view of a first cup and a second cup of a dual end container according to yet another example.

FIG. 5 is a perspective view of another example of a first cup 512 and a second cup 514 which may be used in the dual end container 100 according to yet another example. The first cup 512 has an interior volume 564 and an outer surface 560 with a first male thread 517 formed thereon. The second cup 514 has an interior volume 566 and an outer surface 562 with a second male thread 523 formed thereon. In one example, the first male thread 517 and the second male thread 523 are interleaved. The diameter of the outer surface 560 of the first cup 512 and the diameter of the outer surface 562 of the second cup 514 are equal. The interior volume 564 of the first cup 512 and the interior volume 566 of the second cup 514 may also be equal.

In operation, the first male thread 517 of the first cup 512 interacts with the first threaded member of the driving member 110 (not shown), which may be modified to operate with the configuration of the first cup 512 and the second cup 514, and the second male thread 523 interacts with the second threaded member of the driving member 110. When the first shell 116, which may be modified to accommodate the configuration of the first cup 512, is rotated relative to the driving member 110 and the first cup 512 is rotationally constrained relative to the first shell 116, the first cup 512 moves axially along the longitudinal axis 102 of the dual end container 100. Alternatively, when the driving member 110 is rotated relative to the first shell 116 and the first cup 512 is rotationally constrained relative to the first shell 116, the first cup 512 moves axially along the longitudinal axis 102 of the dual end container 100. More specifically, rotating the first shell 116 or the driving member 110 results in interfacing of the first male thread 517 with the first threaded member, 230. In one example, the first threaded member 230 may be a first female thread. Rotating the first shell 116 or the driving member 110 in a first direction extends the first cup 512 and the first product 124 longitudinally out of the dual end container 100, whereas rotating the first shell 116 or the driving member 110 in a second direction retracts the first cup 512 and the first product 124 longitudinally into the dual end container 100.

Similarly, when the second shell 118, which may be modified to accommodate configuration of the second cup 514, is rotated relative to the driving member 110 and the second cup 514 is rotationally constrained relative to the second shell 118, the second cup 514 moves axially along the longitudinal axis 102 of the dual end container 100. Alternatively, when the driving member 110 is rotated relative to the second shell 118 and the second cup 514 is rotationally constrained relative to the second shell 118, the second cup 514 moves axially along the longitudinal axis 102 of the dual end container 100. Rotating the second shell 118 or the driving member 110 results in interfacing of the second male thread 523 with the second threaded member 232, which may be modified to accommodate the configuration of the second cup 514. Rotating the second shell 118 or the driving member 110 in a first direction extends the second cup 514 and the second product 126 longitudinally out of the dual end container 100, whereas rotating the second shell 118 or the driving member 110 in a second direction retracts the second cup 514 and the second product 126 longitudinally into the dual end container 100.

It is a benefit of the present disclosure that the overall length of the dual end cosmetic container is reduced due to use of the integrated mechanism in which the second cup is partially housed within the first cup. In other words, the present disclosure makes use of the space that is necessary for a single extension and retraction mechanism by fitting a second extension and retraction mechanism therein. These integrated mechanisms allow for extension and retraction of two cosmetic products out of opposite ends of the container independently of one another. It is another benefit of the present disclosure that the mechanisms described herein are designed to prevent accidental actuating of the cosmetic products. More specifically, the only shell, and thus product, which will be actuated and extended or retracted along the length of the container is the product desired by the consumer.

Figure 6:
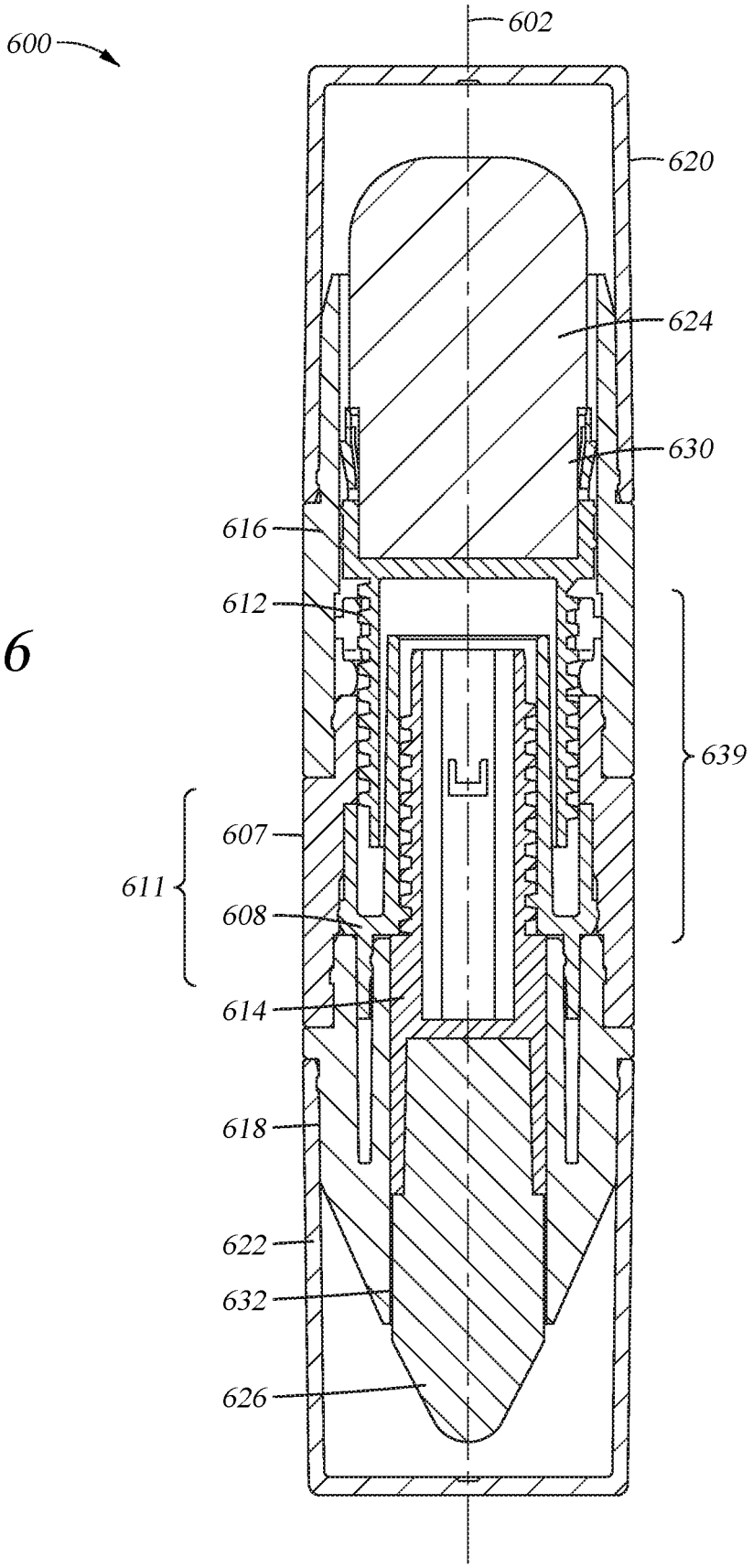
FIG. 6 is a schematic cross-sectional view of a dual end container according to another example.
Figure 7:
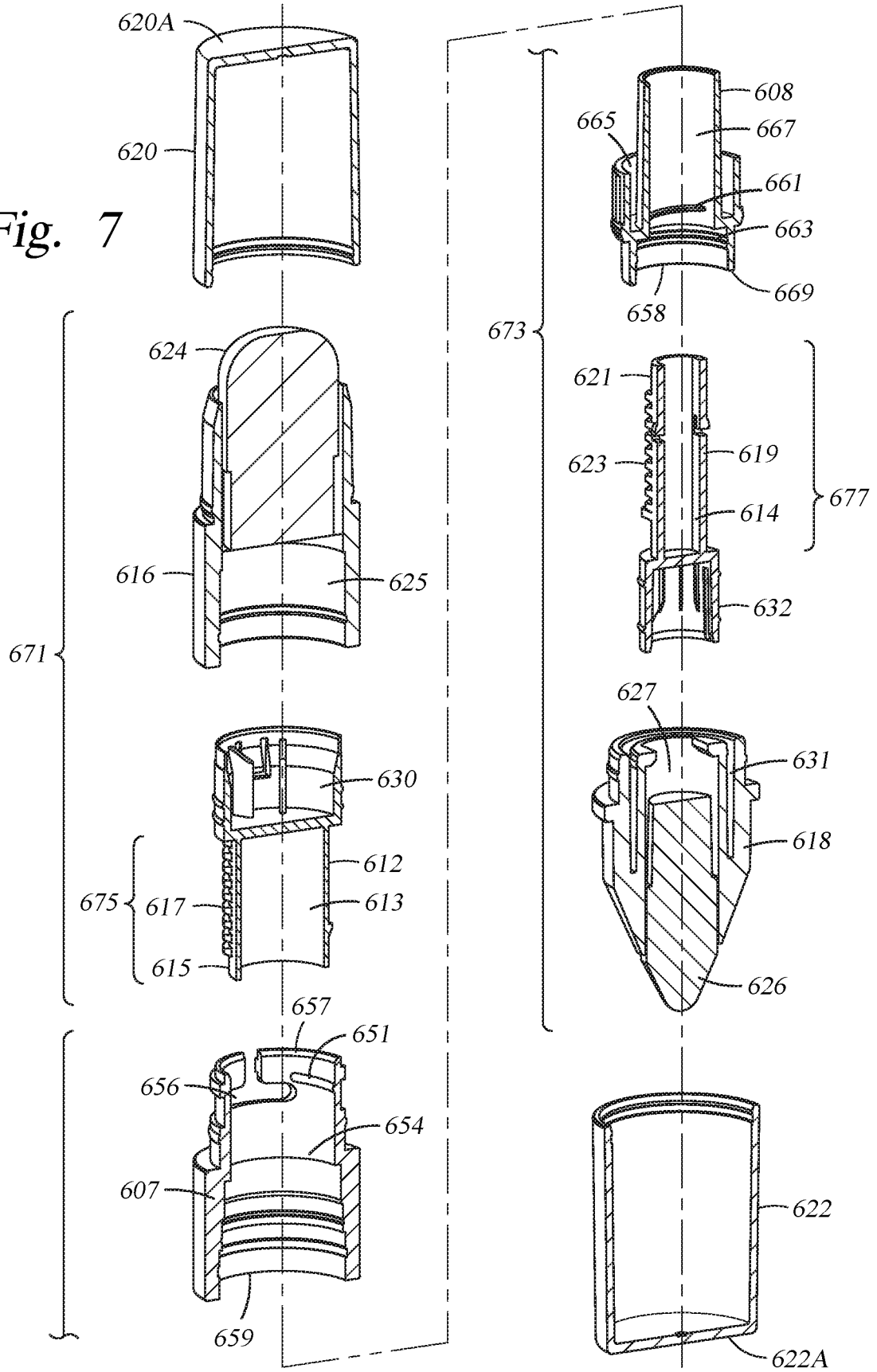
FIG. 7 is an exploded cross-sectional view of the dual end container of FIG. 6.

FIG. 6 is a schematic cross-sectional view of a dual end container 600 according to another example. FIG. 7 is an exploded cross-sectional view of the dual end container 600 of FIG. 6. The dual end container 600 is similar to the dual end container 100. However, the dual end container 600 includes a first driving member 607 and a second driving member 608, which when coupled together form a driving member assembly 611. In addition to the benefits described above, using the separate and distinct first driving member 607 and second driving member 608 allows for each end of the dual end container 600 to be filled with a product individually to reduce production time and to protect the filled products during subsequent assembly.

The dual end container 600 includes a first sub-assembly 671 and a second sub-assembly 673. The first sub-assembly includes a first cup 612, which is surrounded by a first shell 616, and the first driving member 607. A first cap 620 couples with the first shell 616. The second sub-assembly 673 includes a second cup 614, which is surrounded by a second shell 618, and the second driving member 608. A second cap 622 couples with the second shell 618. As shown in FIGS. 6-7, the second shell 618 includes a first recessed channel 631 which is configured to receive a portion 669 of the second driving member 608. Additionally, the second driving member 608 is configured to surround a portion of the second cup 614 and thus stabilize the second cup 614 within the second driving member 608 and the second shell 618 when the dual end container 600 is in two sub-assemblies, a first sub-assembly 671 and a second sub-assembly 673.

When the first sub-assembly 671 and the second sub-assembly 673 are coupled together, as described in more detail below, the first driving member 607 and the second driving member 608 are located between a first cup 612 and a second cup 614 along the longitudinal axis 602. Each of the first driving member 607, the second driving member 608, the first cup 612, the second cup 614, the first shell 616, the second shell 618, the first cap 620, and the second cap 622 may be made of plastic, or any other suitable material.

The first cup 612 is configured to contain a first product 624. For example, the first cup 612 generally includes a product container portion 630 for holding the first product 624. The second cup 614 is configured to contain a second product 626. Likewise, the second cup 614 generally includes a product container portion 632 for holding the second product 626. In one example, the first product 624 and the second product 626 include a cosmetic product, such as lipstick, lip gloss, foundation, mascara, eye liner, eye shadow, or cheek color. In another example, one or both of the first product 624 and the second product 626 may be replaced with cosmetic applicators, such as a sponge or a brush. In yet another example, the first product 624 and the second product 626 are personal care products, such as deodorant. In still further examples, one or both of the first product 624 and the second product 626 are skincare products. In even further examples, the first product 624 and the second product 626 are hair products or pet products.

The dual end container 600 includes a threaded region 639 that moves one or both of the first cup 612 and the second cup 614 along the longitudinal axis 602 when relative rotational movement is provided between the driving member assembly 611 and the first cup 612 or the second cup 614. The first cup 612 is adapted to move along the longitudinal axis 602 in an enlarged internal region 625 of the first shell 616. Likewise, the second cup 614 is adapted to move along the longitudinal axis 602 in an enlarged internal region 627 of the second shell 618.

As shown in FIG. 7, the first driving member 607 is a hollow body enclosing an interior volume 654 and has a slotted portion 656, such as a T slot, groove, or other cut out, towards a first end 657. A second end 659 is opposite the first end 657. Further, the first driving member 607 has a first threaded member 651, which is a female threaded member. The second driving member 608 has an interior volume 667 with a second threaded member 661, which is a female threaded member, near a first end 658. The second driving member 608 further includes a coupling member 663 near the first end 658. The coupling member 663 is configured to couple the second driving member 608 to the second shell 618, for example by snapping into, or otherwise coupling with, the first recessed channel 631. A portion 675 of first cup 612 is received in the interior volume 654. A portion 677 of the second cup 614 received in the interior volume 667. The first cup 612 has an interior volume 613 and an outer surface 615 with a first male thread 617 formed thereon. The second cup 614 has an interior volume 619 and an outer surface 621 with a second male thread 623 formed thereon. A diameter of the outer surface 621 is less than a diameter of the interior volume 613 such, when the dual end container 600 is finally assembled, that the second cup 614 is at least partially housed within the interior volume 613 of the first cup 612. The first threaded member 651 of the first driving member 607 engages with first male thread 617 of the first cup 612 and the second threaded member 661 of the second driving member 608 engages with second male thread 623 of the second cup 614.

As shown, the first male thread 617 is a right-handed thread and the second male thread 623 is a right-handed thread. In another example, which may be combined with one or more examples described herein, the first male thread 617 and the second male thread 623 are left-handed threads. In another example, which may be combined with one or more examples described herein, the first male thread 617 is a right-handed thread and the second male thread 623 is a left-handed thread. In yet another example, which may be combined with one or more examples described herein, the first male thread 617 is a left-handed thread and the second male thread 623 is a right-handed thread.

The first cap 620 is removable from the first shell 616 to expose the first product 624 for use. When the first product 624 is not in use, the first cap 620 is generally used to cover the first product 624. The second cap 622 is removable from the second shell 618 to expose the second product 626 for use. When the second product 626 is not in use, the second cap 622 is generally used to cover the second product 626. As shown in FIGS. 6-7, the first cap 620 has a top surface 620A that is flat and the second cap 622 has a top surface 622A that is flat. It is also contemplated that one or more of the top surfaces 620A, 622A are tapered. According to other alternate examples, the first cap 620 and the second cap 622 may have other desired shapes. The first cap 620 may be sized to removeably snap fit to or interference fit with the first shell 616. The second cap 622 may be sized to loosely cover the second shell 618.

The first cup 612 is moveable along the longitudinal axis 602 of the dual end container 600 by providing relative rotational movement between the first shell 616 and the driving member assembly 611. The second cup 614 is moveable along the longitudinal axis 602 of the dual end container 600 by providing relative rotational movement between the second shell 618 and the driving member assembly 611.

The first driving member 607 is engaged with the first shell 616 and the second shell 618. The first driving member 607 is rotatable relative to the first shell 616. The first driving member 607 is rotatable relative to the second shell 618. In operation, when the first shell 616 is rotated relative to the first driving member 607 and the first cup 612 is rotationally constrained relative to the first shell 616, the first cup 612 moves axially along the longitudinal axis 602 of the dual end container 600. Alternatively, when the first driving member 607 is rotated relative to the first shell 616 and the first cup 612 is rotationally constrained relative to the first shell 616, the first cup 612 moves axially along the longitudinal axis 602 of the dual end container 600. More specifically, rotating the first shell 616 or the first driving member 607 results in interfacing of the first male thread 617 with the first threaded member 651. Rotating the first shell 616 or the first driving member 607 in a first direction, for example to the left side of the page as shown in the FIGS. 6-7, advances the first cup 612 and the first product 624 axially away from the second cup 614 to expose the first product 624 for use, whereas rotating the first shell 616 or the first driving member 607 in a second direction, for example to the right side of the page as shown in the FIGS. 6-7, retracts the first cup 612 and the first product 624 longitudinally towards the second cup 614 of the dual end container 600 to allow the first cap 620 to enclose and cover the first product 624.

Similarly, when the second shell 618 is rotated relative to the first driving member 607 and the second cup 614 is rotationally constrained relative to the second shell 618, the second cup 614 moves axially along the longitudinal axis 602 of the dual end container 600. Alternatively, when the first driving member 607 is rotated relative to the second shell 618 and the second cup 614 is rotationally constrained relative to the second shell 618, the second cup 614 moves axially along the longitudinal axis 602 of the dual end container 600. Rotating the second shell 618 or the first driving member 607 results in interfacing of the second male thread 623 with the second threaded member 661. Rotating the second shell 618 or the first driving member 607 in a first direction, for example clockwise (to the left side of the page as shown in the FIGS. 6-7), advances the second cup 614 and the second product 626 axially away from the first cup 612 to expose the second product 626 for use, whereas rotating the second shell 618 or the first driving member 607 in a second direction, for example counterclockwise (to the right side of the page as shown in the FIGS. 6-7), retracts the second cup 614 and the second product 626 longitudinally towards the first cup 612 to allow the second cap 622 to enclose and cover the second product 626.

As described above, once finally assembled, the dual end container 600 is similar to the dual end container 100 disclosed herein. Like the dual end container 100, the dual end container 600 may also include various stop mechanisms and shoulders to prevent overextension of the products and disassembly of the various parts of the dual end container 600. For example, the first shell 616 may include a stop mechanism, such as a first stop 128 shown in FIGS. 1A-2B, which interacts with a shoulder, such as the shoulder 134 shown in FIGS. 1A-2B, which extends radially outward from the product container portion 630. When the first cup 612 is moved along the longitudinal axis 602 away from the first driving member 607, the shoulder contacts the first stop to prevent additional movement of the first cup 612 along the longitudinal axis 602.

Likewise, the second shell 618 may include a stop mechanism, such as the second stop 129 shown in FIGS. 1A-2B, that interacts with a shoulder, such as the shoulder 136 that extends radially outward from the product container portion 132 shown in FIGS. 1A-2B. When the second cup 614 is moved along the longitudinal axis 602 away from the first driving member 607, the shoulder contacts the second stop to prevent additional movement of the second cup 614 along the longitudinal axis 602. Additionally, the slotted portion 656 weakens the reacting force of the first threaded member 651. In other words, the slotted portion 656 prevents the first cup 612 from forcing the first shell 616 and the first driving member 607 apart.

As discussed above, the first sub-assembly 671 and the second sub-assembly 673 of the dual end container 600 are configured to be joined together. The first sub-assembly 671 and the second sub-assembly 673 can be joined by any suitable joining technology. Suitable joining technologies include, but are not limited to, snap fitting, press fitting, bonding, welding, screwing, and quarter turned fastening. As shown in FIGS. 6-7, the first driving member 607 and the second driving member 608 are configured to be joined together to form the driving member assembly 611. For example, the second driving member 608 includes a recessed portion 665 configured to receive a portion of the first cup 612.

Accordingly, the product container portions 630 and 632, of the first cup 612 and the second cup 614 can each be filled separately, while the dual end container 600 is divided into the first sub-assembly 671 and the second sub-assembly 673. Then, the first sub-assembly 671 and the second sub-assembly 673 can be joined together. A method of assembling a dual end container according to examples disclosed herein generally includes, forming a first dual end container portion comprising the first cup coupled to the first shell and to the first driving member, forming a second dual end container portion comprising the second cup coupled to the second shell and to the second driving member, filling the first cup with a first product, filling the second cup with a second product, and then, after the filling, coupling the first dual end container portion to the second dual end container portion. Generally, the filled product is wound down and the cap is disposed over the filled product in each of the first dual end container portions before they are joined together to protect the filled products. A mold may be used to fill and form the product in a desired shape for the dual end container. For example, a mold is generally used to form the product into a bullet shape when the product is a cosmetic product, such as a lipstick or foundation.

Filling the first cup 612 and the second cup 614 separately reduces production time and provides protection of the products during filling and assembly.

While the foregoing is directed to examples of the present disclosure, other and further examples of the disclosure may be devised without departing from the basic scope thereof, and the scope thereof is determined by the claims that follow.

The invention claimed is:

1. A dual end container comprising:

a first cup;

a second cup, the first and second cups facing in opposite directions and aligned along a longitudinal axis of the dual end container; and a driving member assembly positioned between the first cup and the second cup and adapted to selectively move the first cup and the second cup, wherein the driving member assembly comprises:

a first driving member having a first threaded member coupled to the first cup, the first threaded member having an interior volume; and a second driving member having a second threaded member coupled to the second cup and at least partially disposed within the interior volume of the first threaded member, wherein the second driving member comprises a recessed portion configured to receive a portion of the first cup.

2. The dual end container of claim 1, wherein the first threaded member has a first female thread that engages a first male thread disposed on the first cup, and wherein the second threaded member has a second female thread that engages a second male thread disposed on the second cup.

3. The dual end container of claim 1 further comprising:

a first shell disposed over the first cup; and a second shell disposed over the second cup.

4. The dual end container of claim 3, wherein the second driving member is at least partially disposed in the second shell.

5. The dual end container of claim 3, wherein the first cup is moveable along the longitudinal axis of the dual end container by providing relative rotational movement between the first shell and the driving member assembly.

6. The dual end container of claim 1, wherein the first driving member and the second driving member are separate and distinct to accommodate separate filling of the first cup and the second cup.

7. The dual end container of claim 1, wherein the first driving member and the second driving member are joined together.

8. A dual end container comprising:

a driving member assembly comprising:

a first driving member having an interior volume formed therein with a first female thread; and a second driving member having an interior volume formed therein with a second female thread, the second driving member being joined with the first driving member to form the driving member assembly;

a first cup coupled to the first driving member, the first cup having an interior volume and an outer surface with a first male thread formed thereon; and a second cup coupled to the second driving member, the second cup having an outer surface with a second male thread formed thereon, a diameter of the outer surface of the second cup being less than a diameter of the interior volume of the first cup and the second cup is at least partially housed within the interior volume of the first cup.

9. The dual end container of claim 8 further comprising:

a first shell disposed over the first cup; and a second shell disposed over the second cup.

10. The dual end container of claim 9, wherein a portion of the second driving member is disposed in the interior volume of the first driving member, and wherein a portion of the second shell is disposed within the interior volume of the second driving member.

11. The dual end container of claim 9, wherein the second driving member comprises a recessed portion configured to receive a portion of the first cup.

12. The dual end container of claim 9, wherein the second shell includes a recessed portion configured to receive a portion of the second driving member.

13. The dual end container of claim 8, wherein the first driving member and the second driving member are joined by a snap fit, a press fit, bonding, welding, one or more screws, or a quarter turned fastener.

14. The dual end container of claim 8, wherein the first male thread interfaces with the first female thread, and wherein the second male thread interfaces with the second female thread.

15. The dual end container of claim 8 further comprising:

a first product coupled to the first cup; and a second product coupled to the second cup.

16. The dual end container of claim 15, wherein the first product and the second product are products selected from a group consisting of cosmetic products, skincare products, dental products, personal care products, cosmetic applicators and pet products.

* * * * *